US006508457B1

(12) United States Patent
Knudson et al.

(10) Patent No.: US 6,508,457 B1
(45) Date of Patent: Jan. 21, 2003

(54) VINYL FENCE POST MOUNT

(75) Inventors: Mark J. Knudson, Greenfield, WI (US); Benjamin J. Paprocki, West Allis, WI (US); David M. Raschka, Waukesha, WI (US)

(73) Assignee: Modern Fence Technologies, East Troy, WI (US)

( * ) Notice: Subject to any disclaimer, the term of this patent is extended or adjusted under 35 U.S.C. 154(b) by 0 days.

(21) Appl. No.: 09/938,115

(22) Filed: Aug. 23, 2001

(51) Int. Cl.[7] ..... E04H 17/14

(52) U.S. Cl. ..... 256/65.01; 256/65.02; 256/65.14; 256/19; 256/1

(58) Field of Search ..... 256/1, 19, 21, 256/24, 59, 65.01, 65.02, 65.14; 248/159, 519

(56) References Cited

U.S. PATENT DOCUMENTS

| | | | | | |
|---|---|---|---|---|---|
| 383,343 | A | * | 5/1888 | Coker | |
| 1,545,456 | A | * | 7/1925 | Rastetter | |
| 3,113,760 | A | * | 12/1963 | Huret et al. | |
| 3,698,564 | A | * | 10/1972 | Muller | 211/119.003 |
| 3,875,699 | A | * | 4/1975 | Lamarre | 138/115 |
| 4,249,354 | A | * | 2/1981 | Wynn | 52/309.12 |
| 4,741,513 | A | * | 5/1988 | Smith | 256/21 |
| 5,651,534 | A | * | 7/1997 | Yoder | 256/19 |
| 5,704,188 | A | * | 1/1998 | Coulis | 248/156 |
| 5,860,636 | A | * | 1/1999 | Duncan et al. | 256/1 |
| 5,960,601 | A | * | 10/1999 | Offutt | 256/1 |
| 6,141,928 | A | * | 11/2000 | Platt | 256/65.14 |
| 6,213,452 | B1 | * | 4/2001 | Pettit et al. | 248/188.8 |

* cited by examiner

*Primary Examiner*—Lynne H. Browne
*Assistant Examiner*—James M. Hewitt
(74) *Attorney, Agent, or Firm*—Donald J. Ersler

(57) ABSTRACT

A vinyl fence post mount includes a base, a first support member and a second support member. The first support member is bent along a length thereof to form two first legs which are at an obtuse angle to each other. The second support member is bent along a length thereof to form two second legs which are at an obtuse angle to each other. The lengthwise edges of each leg are preferably bent toward each other. A first bent edge of the first support member is attached to a second bent edge of the second support member. The bottom ends of the support members are attached to the base. At least two mounting holes are formed outside the cross sectional perimeter of the support members. Preferably, each mounting hole is formed substantially in-line with a leg of one of the support members. In a second embodiment, the legs of each support member are bent substantially perpendicular to each other and the lengthwise edges of each leg are not bent. In a third embodiment, a straight first and second support member are used.

2 Claims, 5 Drawing Sheets

VINYL FENCE POST MOUNT

BACKGROUND OF THE INVENTION

1. Field of the Invention

The present invention relates generally to vinyl fences and more specifically to a vinyl fence post mount which is stronger than that of the prior art.

2. Discussion of the Prior Art

Presently, there is a vinyl fence post mount which includes a substantially X-shaped cross section support member mounted to a base with a plurality of mounting holes. However, this post mount has at least one drawback. The mounting holes formed through the base are located within the cross sectional area of the support member. The location of the mounting holes do not provide the base with optimal mounting strength from forces applied perpendicular to a length of the support member. The perimeter of the base is also flush with the cross sectional perimeter of the support member. Further, straight support sections are used which do not afford the post maximum bending strength.

Accordingly, there is a clearly felt need in the art for a vinyl fence post mount which has an increased bolt circle, an improved support member, an enlarged base, and each mounting hole located substantially in-line with a leg of each support member.

SUMMARY OF THE INVENTION

The present invention provides a vinyl fence post mount which is designed to be stronger than that of the prior art. The vinyl fence post mount includes a base, a first support member and a second support member. The first support member is bent along a length thereof to form two first legs which are at an obtuse angle to each other. The lengthwise edge of each first leg is preferably bent toward each other to increase the strength thereof. The second support member is bent along a length thereof to form two second legs which are at an obtuse angle to each other. A lengthwise edge of each second leg is preferably bent toward each other to increase the strength thereof.

A first bent edge of the first support member is attached to a second bent edge of the second support member with any suitable attachment method such as welding. The bottom ends of the support members are attached to the base with any suitable attachment method such as welding. The perimeter of the base is greater than the cross sectional perimeter of the support members such that at least two mounting holes may be formed outside the cross sectional perimeter of the support members. Preferably, each mounting hole is formed substantially in-line with a leg of one of the support members.

In a second embodiment, the legs of each support member are bent substantially perpendicular to each other and the lengthwise edges of each leg are not bent. In a third embodiment, straight first and second support members are used. The first and second support members are slotted to fit into each other.

Accordingly, it is an object of the present invention to provide a vinyl fence post mount with mounting holes that are located outside the cross sectional perimeter of the support members.

It is a further object of the present invention to provide a vinyl fence post mount with each mounting hole located substantially in-line with a leg of one of the support members.

Finally, it is another object of the present invention to provide a vinyl fence post mount having support members which are each bent along a length thereof to form two legs.

These and additional objects, advantages, features and benefits of the present invention will become apparent from the following specification.

DETAILED DESCRIPTION OF THE PREFERRED EMBODIMENTS

Figure 1:
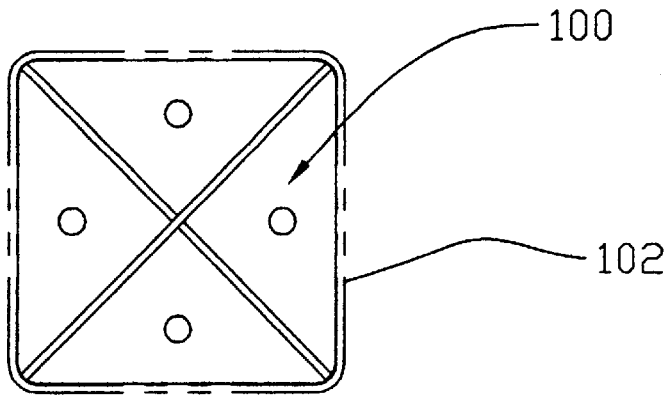
FIG. 1 (PRIOR ART)
FIG. 1 is a top view of a prior art vinyl fence mounting post.
Figure 2:
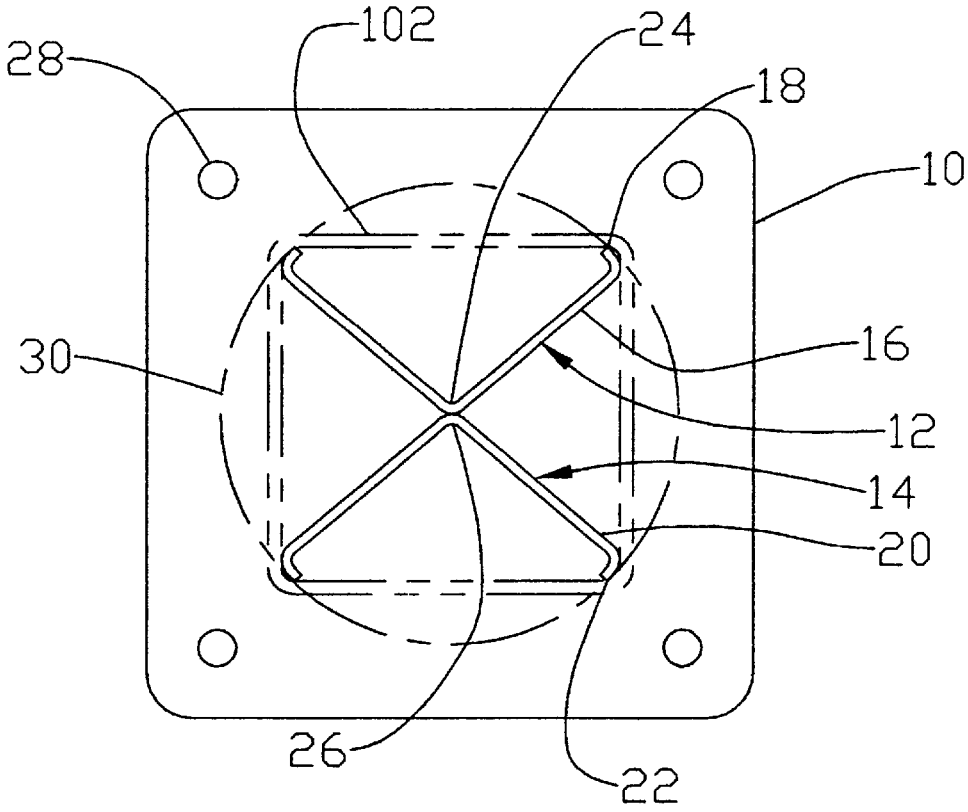
FIG. 2 is a top view of a vinyl fence mounting post in accordance with the present invention.
Figure 3:
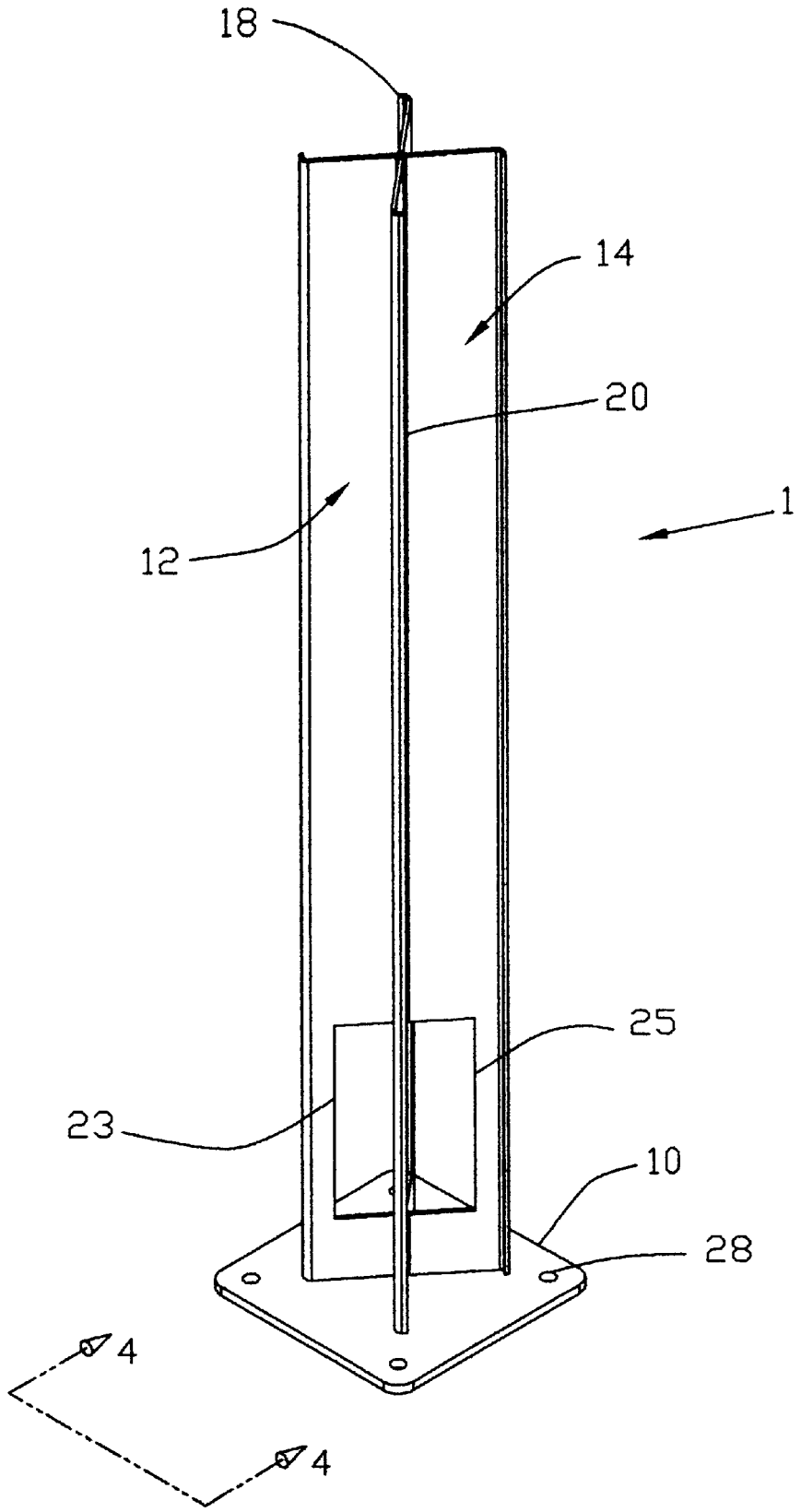
FIG. 3 is a perspective view of a vinyl fence mounting post in accordance with the present invention.
Figure 4:
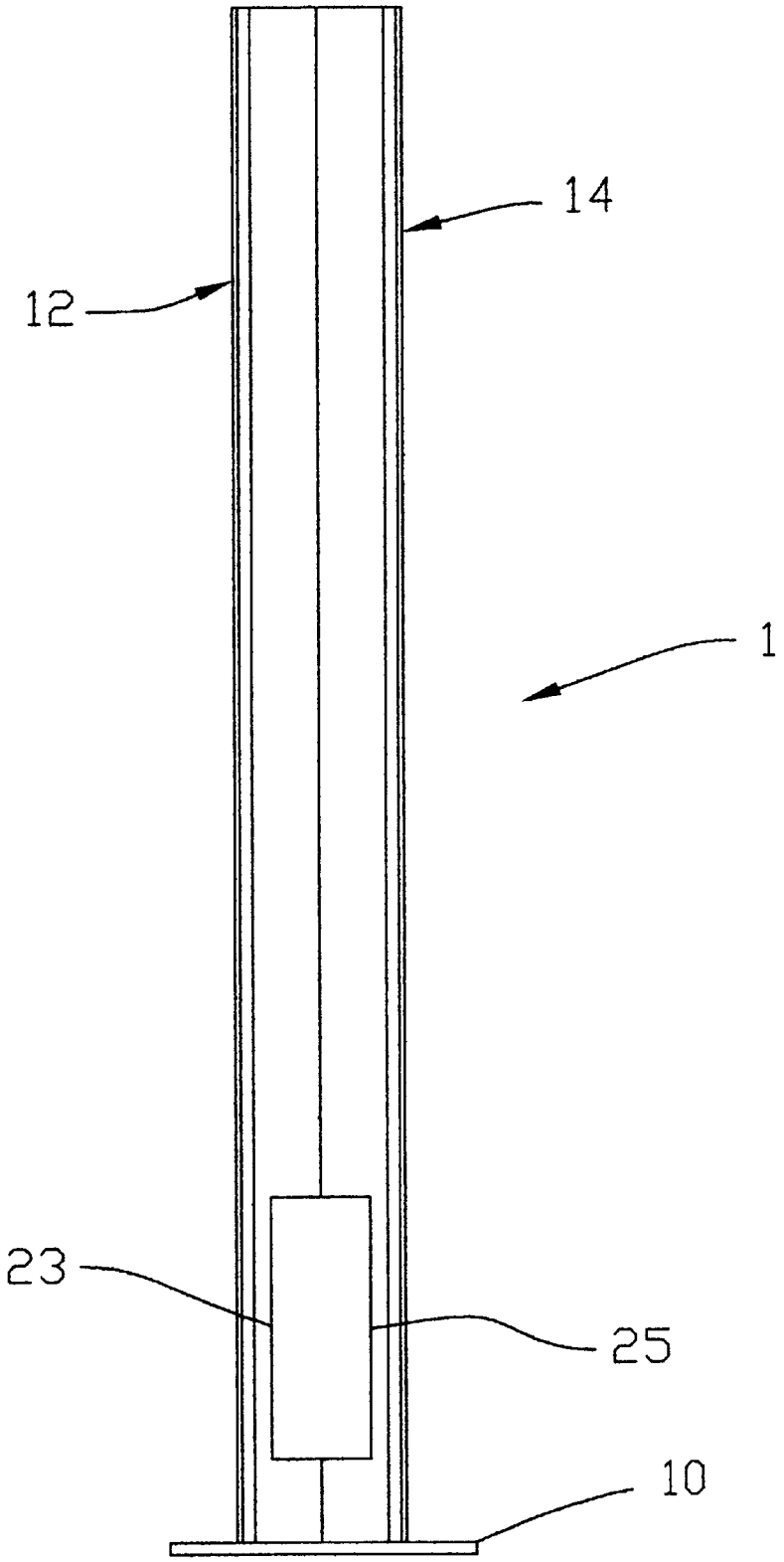
FIG. 4 is a front view of a vinyl fence mounting post in accordance with the present invention.

With reference now to the drawings, and particularly to FIG. 1, there is shown a top view of a prior art vinyl fence mounting post 100. With reference to FIGS. 2–4, a vinyl fence mounting post includes a base 10, a first support member 12 and a second support member 14. The first support member 12 is bent along a length thereof to form two first legs 16 which are at an obtuse angle to each other. A first lengthwise edge 18 of each first leg 16 is preferably bent toward each other to the increase the strength thereof. The second support member 14 is bent along a length thereof to form two second legs 20 which are at an obtuse angle to each other. A second lengthwise edge 22 of each second leg 20 is preferably bent toward each other to increase the strength thereof.

Preferably, the bent lengthwise edges provide 8-point contact with the inside cross sectional perimeter of a rectangular vinyl post 102 slid over the first and second support members. The first and second support members may also receive a vinyl post that has a cross section which is hexagon, octagon, round, or any other suitable shape. Without the bent lengthwise edges, the edges of the support sections would contact the corners of the rectangular vinyl post 102. A first rail opening 23 is preferably formed through substantially a bottom of the first support member 12 and a second rail opening 25 is preferably formed through substantially a bottom of the second support member 14. The first and second rail openings being sized to receive a rail.

A first bent edge 24 of the first support member 12 is attached to a second bent edge 26 of the second support member 14 with any suitable attachment method such as welding. The bottom ends of the first and second support members are attached to the base 10 with any suitable attachment method such as welding. The perimeter of the base 10 is greater than the cross sectional perimeter of the first and second support members. At least two mounting holes 28 are formed outside the cross sectional perimeter of the first and second support members as defined by a circle 30. Preferably, each mounting hole 28 is formed substantially in-line with a leg of one of the first and second support members.

Figure 5:
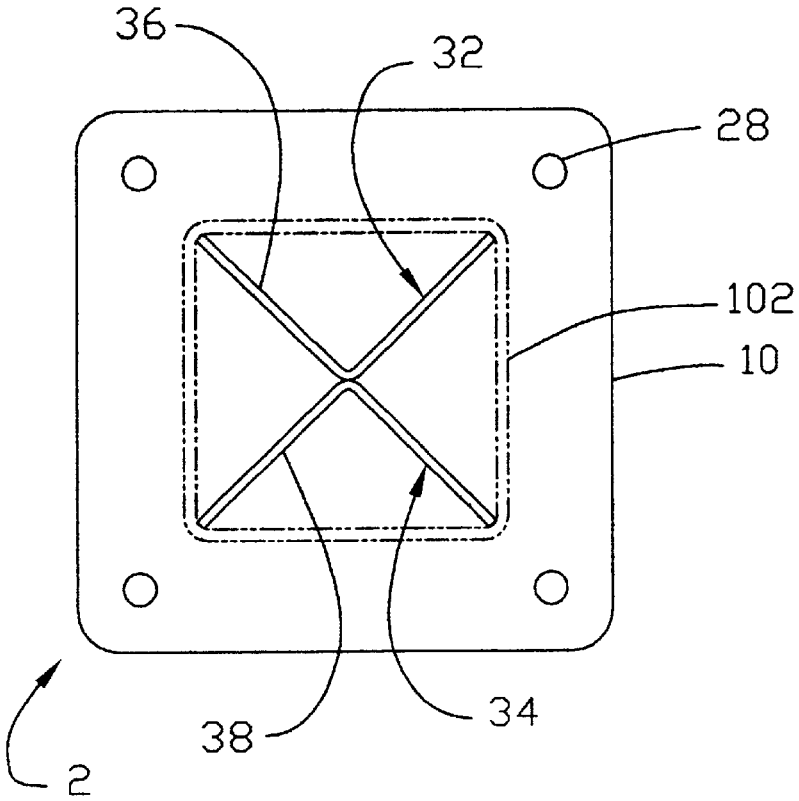
FIG. 5 is a top view of a second embodiment of a vinyl fence mounting post in accordance with the present invention.

With reference to FIG. 5, a second embodiment of the vinyl fence mounting post 2 includes a first support member 32 and a second support member 34. The first support member 32 is bent along a length thereof to form two first legs 36 which are substantially perpendicular to each other. The second support member 34 is bent along a length thereof to form two second legs 38 which are substantially perpendicular to each other. However, the lengthwise edges of each leg are not bent as in the first embodiment. The lengthwise edges of the first and second support members contact the corners of a rectangular vinyl fence post 102.

Figure 6:
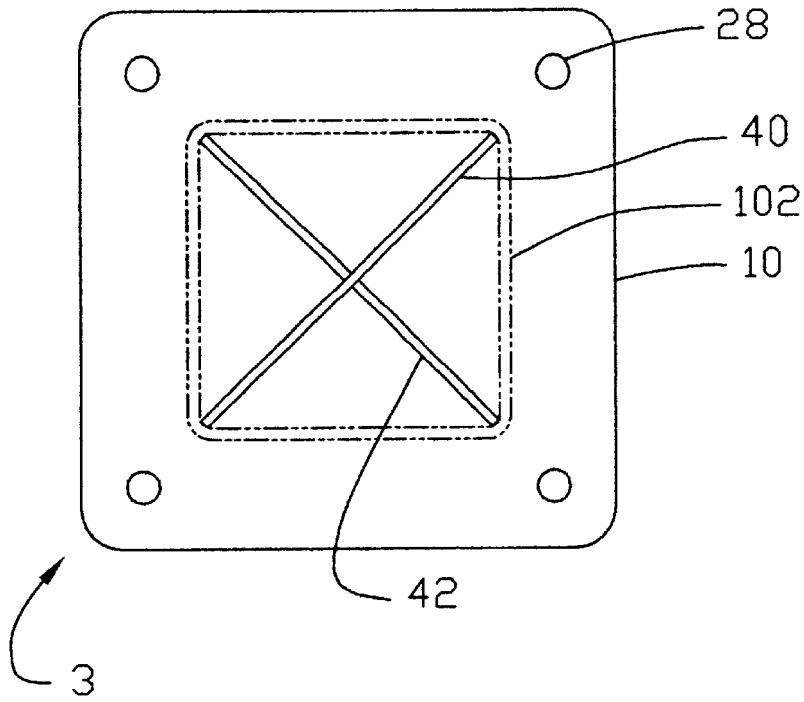
FIG. 6 is a top view of a third embodiment of a vinyl fence mounting post in accordance with the present invention.
Figure 7:
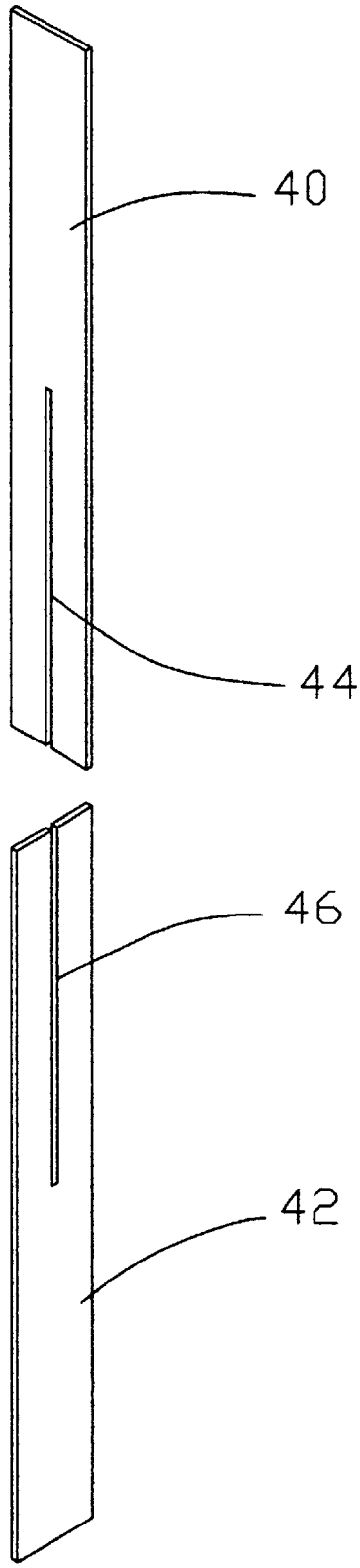
FIG. 7 is an exploded view of first and second support members of a third embodiment of a vinyl fence mounting post in accordance with the present invention.

With reference to FIGS. 6 & 7, a third embodiment of the vinyl fence mounting post 3 includes a first support member 40 and a second support member 42. A first slot 44 is formed in a length of the first support member 40 and a second slot 46 is formed in a length of the second support member 42. The first and second support members are inserted into each other and preferably further secured to each other by an additional attachment method such as welding. The lengthwise edges of the first and second support members contact the corners of the rectangular vinyl post 102.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A vinyl fence post mount in combination with a vinyl fence post, comprising:

a first support member being bent along a length thereof to form two first legs which are at an obtuse angle to each other;

a second support member being bent along a length thereof to form two second legs which are at an obtuse angle to each other, a first bent edge of said first support member being attached to a second bent edge of said second support member;

said vinyl fence post mount having a length defined by the length of said first and second support members, said vinyl fence post encasing said length of said vinyl fence post mount;

a first rail opening is formed near a bottom of said first support member and a second rail opening is formed near a bottom of said second support member, said first and second rail openings being sized to receive a rail;

a lengthwise edge of each of said two first legs being bent toward each other, a lengthwise edge of each of said two second legs being bent toward each other, each of said lengthwise edges contacting an inside perimeter of said vinyl fence post; and a base having a perimeter which is greater than a cross sectional perimeter of said first and second support members, at least two mounting holes being disposed outside said cross sectional perimeter of said first and second support members, a bottom of said first and second support members being attached to said base.

2. The vinyl fence post mount and vinyl fence post combination of claim 1 wherein:

each said mounting hole of said at least two mounting holes being disposed in-line with one of said first and second legs.

* * * * *